United States Patent [19]

Goldstein

[11] Patent Number: 4,774,283

[45] Date of Patent: Sep. 27, 1988

[54] NONWOVEN BINDERS OF VINYL ACETATE/ETHYLENE/SELF-CROSSLINKING MONOMERS/ACRYLAMIDE COPOLYMERS HAVING IMPROVED BLOCKING RESISTANCE

[75] Inventor: Joel E. Goldstein, Allentown, Pa.

[73] Assignee: Air Products and Chemicals, Inc., Allentown, Pa.

[21] Appl. No.: 20,917

[22] Filed: Mar. 2, 1987

[51] Int. Cl.[4] ..... C08L 31/04; C08L 33/26

[52] U.S. Cl. ..... 524/816; 523/222; 524/458; 524/812; 526/304

[58] Field of Search ..... 526/304; 523/222; 524/458, 816, 812

[56] References Cited

U.S. PATENT DOCUMENTS

| | | | |
|---|---|---|---|
| 3,444,124 | 5/1969 | Talet | 524/512 |
| 4,164,489 | 8/1979 | Daniels et al. | 524/733 |
| 4,289,676 | 9/1981 | Czauderna et al. | 524/813 |
| 4,439,574 | 3/1984 | Schuppiser et al. | 526/201 |
| 4,448,908 | 5/1984 | Pauly et al. | 523/201 |
| 4,449,978 | 5/1984 | Iacoviello | 427/389.9 |
| 4,481,250 | 11/1984 | Cook et al. | 428/913 |
| 4,590,102 | 5/1986 | Rosamilia et al. | 427/374.1 |
| 4,647,611 | 3/1987 | Goldstein et al. | 524/458 |
| 4,663,410 | 5/1987 | Pinschmidt et al. | 526/263 |

*Primary Examiner*—Herbert J. Lilling

*Attorney, Agent, or Firm*—Michael Leach; James C. Simmons; William F. Marsh

[57] ABSTRACT

A copolymer emulsion for bonding nonwovens demonstrating increased blocking resistance comprising an aqueous medium having colloidally dispersed therein a copolymer consisting essentially of vinyl acetate, ethylene, a crosslinkable comonomer which is an N-acrylamidoglycolic acid or an acrylamidobutyraldehyde dialkyl acetal type compound, and a small amount of an acrylamide.

13 Claims, No Drawings

NONWOVEN BINDERS OF VINYL ACETATE/ETHYLENE/SELF-CROSSLINKING MONOMERS/ACRYLAMIDE COPOLYMERS HAVING IMPROVED BLOCKING RESISTANCE

TECHNICAL FIELD

The present invention relates to binder compositions for nonwoven fabrics comprising copolymerized ethylene and vinyl acetate.

BACKGROUND OF THE INVENTION

Emulsion polymers prepared from vinyl acetate and ethylene provide wide application as binders in industry. Unfortunately, these binders experience unacceptable loss in strength in the presence of water and other solvents. In addition, they exhibit deficiencies in adhesion to the substrates on which they are used. These shortcomings have been reduced by the use of adhesion promoting or crosslinking comonomers and/or post-added crosslinkers.

The most successful of the many chemistries employed is aminoplast technology, especially N-methylolacrylamide (NMA) and urea-formaldehyde (U/F) condensates. While they are low in cost, compatible with aqueous emulsions, rapidly cured under acid catalysis and substrate reactive, they suffer from two deficiencies: the emission of low levels of formaldehyde, a suspect carcinogen; and inadequate adhesion to certain substrates, for example, metal, glass and synthetics such as mylar.

Several monomers have recently been developed which will overcome these deficiencies, but they exhibit a third deficiency when used in a nonwoven binder. The resulting binder emulsion polymer causes blocking, i.e. difficulty in separating two adjacent sheets of bonded nonwoven material. While polymers containing NMA show minor blocking, which is required for efficient rolling of towels and creping of the web, the new monomers demonstrate very hgh blocking to the extent that it is extremely difficult to separate adjacent sheets. Exemplary of such new monomers are N-(meth) acrylamidoglycolic acid and a compound of the formula $$R—NH—(CH_2)_nCH(OR^1)_2$$

wherein R is a $C_3$–$C_{10}$ olefinically unsaturated organic radical having functionality which renders the nitrogen atom electron deficient, $R^1$ is hydrogen or a $C_1$–$C_4$ alkyl group and n is 3 or 4.

U.S. Pat. No. 4,289,676 discloses binder copolymers containing at least 85 wt %

(a) a mixture of from 40–60 parts by weight of styrene and/or acrylonitrile and from 60–40 parts by weight of butadiene or (b) esters of acrylic acid and/or methacrylic acid with alkanols of 1–8 carbon atoms, and/or vinyl esters of acetic acid or propionic acid and/or vinyl chloride, and optionally up to 40 wt % based on total monomers (b), of acrylonitrile, styrene or butadiene, from 0–5 wt % of alpha, beta-monoolefinically unsaturated monocarboxylic acids and/or dicarboxylic acids of 3–5 carbon atoms and/or their amides and 3–10 wt % N-acrylamidoglycolic acid and/or N-methacrylamidoglycolic acid.

U.S. Pat. No. 4,449,978 discloses nonwoven products bonded with a binder comprising a polymer of vinyl acetate/ethylene/N-methylolacrylamide/acrylamide. These nonwoven products have a low residual free formaldehyde content.

U.S. Pat. No. 4,448,908 discloses a latex, the particles of which comprise a polymer core and a shell thereover, the shell comprising a water insoluble monomer of the formula

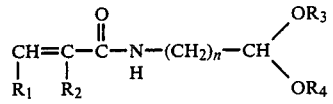

U.S. application Ser. No. 838,973, filed 12 Mar. 1986, discloses a process for preparing a nonwoven binder emulsion containing a crosslinkable vinyl acetate or vinyl acetate/ethylene copolymer prepared by polymerizing in an aqueous dispersion vinyl acetate or vinyl acetate and ethylene with a crosslinkable comonomer of the formula $$R—NH—(CH_2)_n—CH(OR^1)_2$$

by the "trail" addition of the crosslinkable comonomer.

SUMMARY OF THE INVENTION

The present invention provides an aqueous dispersion of vinyl acetate-ethylene copolymers of 35–65 wt % solids which are useful as nonwoven binders. The aqueous dispersion, or emulsion, comprises a copolymer consisting essentially of vinyl acetate, 1–20 wt % ethylene, 0.5–15 wt %, based on vinyl acetate, of an N-acrylamidoglycolic acid or a compound of the formula $$R—NH—(CH_2)_nCH(OR^1)_2$$

wherein R is a $C_3$–$C_{10}$ olefinically unsaturated organic radical having functionality which renders the nitrogen atom electron deficient, $R^1$ is hydrogen or a $C_1$–$C_4$ alkyl group and n is 3 or 4, and 0.1–5 wt % of an acrylamide.

The copolymer emulsions of the invention can be applied to a nonwoven web of fibers to provide a nonwoven bonded substrate by curing the vinyl acetate/ethylene/self-crosslinking monomer copolymers under acid catalysis and heating.

The copolymerization of an acrylamide with the vinyl acetate, ethylene and the defined self-crosslinking monomers provides an emulsion copolymer with a block of hard polymer as opposed to the soft, tacky vinyl acetate/ethylene. It is believed this hard block will probably be on the surface of the particle or as a totally water soluble fraction since acrylamide is more soluble in water than in the organic monomer/polymer droplet. Since the hard segment will be on the surface when a second sheet of nonwoven web is laid across the initial bonded sheet, contact with soft, tacky polymer will be greatly reduced by having the hard polymer segment acting as a shell, thereby increasing block resistance.

DETAILED DESCRIPTION OF THE INVENTION

There is provided an aqueous emulsion comprising an aqueous medium having colloidally dispersed therein a copolymer consisting essentially of vinyl acetate, 1–20 wt % ethylene, 0.5–15 wt % of a particular self-crosslinking monomer, and 0.1–5 wt % of an acrylamide. Such copolymer emulsions which are useful as nonwoven binders would have Brookfield viscosities ranging from 80 to 1800 cps, preferably 300 to 600 cps. The copolymers would have a $T_g$ between −20° and Contemplated as the functional, or operative, equival° C., preferably 15° to 19° C.

Contemplated as the functional, or operative, equivalent of vinyl acetate in the copolymer emulsions, are vinyl esters of formic acid and $C_3$–$C_{18}$ alkanoic acids, such as vinyl formate, vinyl proprionate, vinyl laurate and the like.

The preferred copolymers would contain 6–18 wt % ethylene and especially 7–11 wt % ethylene.

The particular self-crosslinking monomers that are used in the copolymers of the invention are an N-acrylamidoglycolic acid, e.g. N-acrylamidoglycolic acid (AGA) and/or N-methacrylamidoglycolic acid (MethAGA). Whenever "AGA" is used it is to be understood that "MethAGA" is also contemplated.

AGA and a process for its preparation are known from British Pat. No. 1,103,916. AGA can be purchased from Societe Francaise Hoechst (American Hoechst is the distributor in the U.S.).

The AGA units in the vinyl acetate/ethylene copolymers can also advantageously be introduced by reacting emulsion copolymers which contain, as copolymerized units, vinyl acetate and ethylene, and which also contain from 0.3–8 wt % of acrylamide and/or methacrylamide as copolymerized units, with glyoxylic acid in an equivalent amount based on the copolymerized acrylamide or methacrylamide. Both the AGA and acrylamide units could be incorporated by polymerizing acrylamide and reacting with an appropriate amount of glyoxylic acid which is less than an equivalent amount. Further, the copolymers according to the invention, can be prepared by polymerizing the monomer mixture containing acrylamide or methacrylamide in aqueous emulsion in the presence of less than equivalent amount of glyoxylic acid under otherwise conventional conditions.

Other suitable self-crosslinking monomers which enable the vinyl acetate copolymer to function as a nonwoven binder are monomers of the following formula I $$R—NH—(CH_2)_nCH(OR^1)_2 \qquad \text{I}$$

wherein R is a $C_3$–$C_{10}$, preferably $C_3$–$C_5$, olefinically unsaturated organic radical having functionality which renders the nitrogen atom electron deficient, $R^1$ is hydrogen, or a $C_1$–$C_4$ alkyl group, preferably methyl or ethyl, and n is 3 or 4, preferably 3.

Preferably R represents an alpha, beta-unsaturated $C_3$–$C_{10}$ alkenoyl group such as acrylyl, methacrylyl, crotonyl, isocrotonyl, cinnamyl, and the like, especially a (meth)acrylyl group. Contemplated as the functional, or operative, equivalent of the formula I dialkyl acetals are the cyclic hemiamidals of formula II.

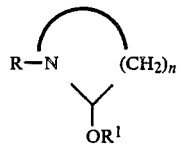

II

The formula I dialkyl acetals under acidic conditions cyclize to the hemiamidals of formula II.

Representative of the dialkyl acetal comonomers of formula I are the following:

acrylamidobutyraldehyde diethyl acetal (ABDA)
acrylamidobutyraldehyde dimethyl acetal (ABDA-Me)
acrylamidobutyraldehyde methylethyl acetal
acrylamidopentanal diethyl acetal (APDA)
crotonamidobutyraldehyde diethyl acetal (CBDA)
methacrylamidobutyraldehyde diisopropyl acetal
diethoxybutylmaleamic acid (DBMA)
cinnamamidobutyraldehyde diethyl acetal (DEBC)
O-allyl-N-(diethoxybutyl)carbamate (ADBC)
O-vinyl-N-(diethoxybutyl)carbamate (DBVC)
N-(diethoxybutyl)-N'-(meth)acryloxyethyl urea (DEBMU)
N-(diethoxyethyl)-N'-(meth) acryloxyethyl urea (DEEMU)

Illustrative of the cyclic hemiamidals of formula II are the following compounds:

N-acryloyl-2-ethoxypyrrolidine (AEP)
N-acryloyl-2-methoxypyrrolidine (AMP)
N-(meth)acryloyl-2-hydroxypyrrolidine (AHP)
N-(allyloxycarbonyl)-2-alkoxypiperidine
N-vinyloxycarbonyl-2-alkoxypiperidine
1-allyl-6-ethoxy-(4-methyl)hexahydropyrimidin-2-one (AEMHP)
N-cinnamoyl-2-alkoxypyrrolidine The preferred dialkyl acetal self-crosslinkable comonomer is the diethyl or dimethyl acetal of acrylamidobutyraldehyde. The above monomers can be referred to as ABDA-type monomers.

Methods for the preparation of crosslinkable comonomers of formula I and formula II as well as other examples of such comonomers are disclosed in copending patent application Ser. No. 714,661 filed 21 Mar., 1985, now abandoned, which is incorporated by reference.

The vinyl acetate/ethylene copolymers comprise about 0.5–15 wt % of the self-crosslinkable comonomers, especially about 2–9 wt %, based on vinyl acetate monomer.

The presence of an acrylamide monomer in the copolymer provides for the significant reduction in blocking in nonwoven sheets. Such acrylamide is preferably present at 0.5–1.5 wt % and may be acrylamide, methacrylamide, crotonamide, N-methylacrylamide or the like, and, of course, any mixture thereof.

The vinyl acetate/ethylene copolymer binders of the invention may optionally include one or more additional polyethylenically unsaturated copolymerizable monomers for enhancing solvent tensiles. Exemplary of such monomers which may be present from 0–0.5 wt %, preferably 0.05–0.25 wt % are triallyl cyanurate, diallyl maleate, diallyl fumarate, hexanediol diacrylate, butylallyl maleate, allyl crotonate, vinyl acrylate, pentaerythritol triacrylate, vinyl methacrylate and the like.

Furthermore, it is preferred to add sodium vinyl sulfonate or another polymerizable anionic surfactant at a level of 0.1 to 2 wt %, based on vinyl acetate, in order to increase the polymer emulsion stability, and improve fiber wetting and penetration which leads to improved tensile strengths.

Methods for preparing vinyl acetate/ethylene copolymer emulsions are well known in the art and any of the customary procedures, together with the incorporation of an ethylene pressure, can be used, such as those emulsion polymerization techniques described in such chemistry texts as POLYMER SYNTHESIS, Vol. I and II, by Stanley R. Sandler and Wolf Karo, Academic Press, New York and London (1974), and PREPARATIVE METHODS OF POLYMER CHEMISTRY, Second Edition, by Wayne R. Sorenson and Tod W. Campbell, Interscience Publishers (John Wiley & Sons), New York (1968).

In general, suitable vinyl acetate/ethylene copolymer emulsions can be prepared by the copolymerization of the monomers in the presence of suitable emulsifying agents, i.e. protective colloids and surfactants, in an aqueous medium under pressures generally not exceeding about 100 atm and in the presence of a redox system which is added incrementally, the aqueous system being maintained by a suitable buffering agent at a pH of about 2–6.

Preferably, the polymerization reaction medium is adjusted to a pH of about 2.5 to decrease the water solubility of the AGA, i.e. prevent ionization of the AGA to keep it in the oil phase, thus affording improved incorporation of AGA in the polymer and improving tensle strengths.

The process first involves a homogenization in which the vinyl acetate suspended in water is thoroughly agitated in the presence of ethylene under the working pressure to effect solution of the ethylene in the vinyl acetate while the reaction medium is gradually heated to a polymerization temperature. The homogenization period is followed by a polymerization period during which the redox system is added incrementally.

The crosslinking monomer AGA may be added all at once with the vinyl acetate and ethylene or incrementally over the course of the polymerization reaction with the latter being preferred.

In carrying out the polymerization, an amount of the vinyl acetate is initially charged to the polymerization vessel and saturated with ethylene. At least about 25% of the total vinyl acetate to be polymerized is initially charged and the remainder of the vinyl acetate is added incrementally during the polymerization. Preferably, all the vinyl acetate is charged initially with no additional incremental supply.

When reference is made to incremental addition, whether of vinyl acetate, crosslinkable comonomer, redox system or any other ingredient, continuous or intermittent, but preferably uniform, additions are contemplated. Such additions are also referred to as "delay" additions.

The quantity of ethylene entering into the copolymer is influenced by the pressure, the agitation and the viscosity of the polymerization medium. Thus, to increase the ethylene content of the copolymer higher pressures, greater agitation and a low viscosity are employed.

The process of forming a vinyl acetate/ethylene copolymer emulsion generally comprises the preparation of an aqueous solution containing the emulsifying system and, optionally, the buffering system. This aqueous solution and the initial or total charge of the vinyl acetate are added to the polymerization vessel and ethylene pressure is applied to the desired value. The pressurized ethylene source can be shut off from the reactor so that the ethylene pressure decays as it is polymerized or can be kept open to maintain the ethylene pressure throughout the reaction, i.e. make-up ethylene. As previously mentioned, the mixture is thoroughly agitated to dissolve ethylene in the vinyl acetate and in the water phase. Conveniently, the charge is brought to polymerization temperature during this agitation period. The polymerization is then initiated by introducing initial amounts of the oxidant, the reductant having been added with the initial charge. After the polymerization has started, the oxidant and reductant are incrementally added as required to continue polymerization. Any other copolymerizable monomer and the remaining vinyl acetate and/or AGA and acrylamide, if any, may be added as separate delays.

With regard to the preparation of vinyl acetate/ethylene/ABDA-type monomer/acrylamide copolymers, another procedure is preferred. This method comprises (1) polymerizing vinyl acetate in an aqueous dispersion reaction medium under a pressurized ethylene atmosphere, (2) commencing the addition of the crosslinkable comonomer to the reaction medium when about 50–80% of the total vinyl acetate in the polymerization recipe has been polymerized, and (3) completing addition of the crosslinkable comonomer after the completion of the addition of the vinyl acetate to the reaction medium and substantially with the finishing of vinyl acetate polymerization; that is to say, complete the addition of the crosslinkable comonomer when the free vinyl acetate content of the reaction mixture is from 0.5–4 wt %, preferably from 1–2 wt %.

Whether the vinyl acetate is added up front, or all or a part is added during the polymerization reaction, the last portion of crosslinkable comonomer will be added after completing the vinyl acetate addition.

This "trail" addition procedure is more fully described in U.S. patent application Ser. No. 838,973, filed 12 Mar. 1986, now U.S. Pat. No. 4,647,611, which is hereby incorporated by reference.

Catalytically effective amounts of various free-radical forming materials can be used in carrying out the polymerization of the monomer, such as peroxide compounds like peracetic acid, benzoyl peroxide, and persulfate salts and azo compounds. Combination-type systems employing both reducing agents and oxidizing agents can also be used, i.e. a redox system. Suitable reducing agents, or activators, including bisulfites, sulfoxylates, alkali metal bisulfite-ketone adducts, or other compounds having reducing properties such as ascorbic acid, erythorbic acid and other reducing sugars. The oxidizing agents include hydrogen peroxide, organic peroxide such as t-butyl hydroperoxide and the like, persulfates, such as ammonium or potassum persulfate, and the like. Specific redox systems which can be used include hydrogen peroxide and zinc formaldehyde sulfoxylate; hydrogen peroxide and erythorbic acid; hydrogen peroxide, ammonium persulfate or potassium persulfate with sodium metabisulfite, sodium bisulfite, ferrous sulfate, zinc formaldehyde sulfoxylate or sodium formaldehyde sulfoxylate; and t-butyl hydroperoxide with sodium bisulfite-acetone adduct. Other free radical forming systems that are well known in the art can also be used to polymerize the monomers. Obviously, for a completely formaldehyde-free binder emulsion, the redox system would comprise a reducing agent that does not liberate formaldehyde; i.e. ascorbic or erythorbic acid, a bisulfite or especially an alkali metal bisulfite-ketone adduct.

The oxidizing agent is generally employed in an amount of 0.01–1%, preferably 0.05–0.5% based on weight of the vinyl acetate introduced into the polymerization system. The reducing agent is ordinarily added in the necessary equivalent amount.

Many of the well known emulsifying agents can be used, such emulsifying agents include ionic and nonionic surfactants such as sodium lauryl sulfate, sodium sulfosuccinate esters and amides, sulfonated alkyl benzenes, alkylphenoxypolyethoxy ethanols and other polyoxyethylene condensates.

The concentration range of the total amount of emulsifying agents useful is from less than 0.5 to 5% based on the aqueous phase of the emulsion regardless of solids content.

In addition to or in place of the surfactants, protective colloids such as polyvinyl alcohol and celluloses like hydroxyethyl cellulose, methyl cellulose, hydroxypropylmethyl cellulose and the like can be used as emulsifying, or stabilizing, agents.

The reaction temperature can be controlled by the rate of redox addition and by the rate of heat dissipation via a reaction vessel water jacket. Generally, it is advantageous to maintain a mean temperature of about 50° C. during the polymerization of the monomers and to avoid temperatures much in excess of 80° C. Although temperatures as low as 0° C. can be used, economically the lower temperature limit is about 30° C.

The reaction time will depend upon variables such as the temperature, the free radical forming source and the desired extent of polymerization. It is generally desirable to continue with the reaction until less than 0.5% of the vinyl acetate remains unreacted.

Vinyl acetate/ethylene/self-crosslinker/acrylamide copolymer emulsions of relatively high solids content can be directly produced having a solids content of 35–60% or more.

The vinyl acetate/ethylene copolymer binders of the invention can be used to prepare nonwoven products, or fabrics, by a variety of methods known in the art which, in general, involve the impregnation of a loosely assembled mass of fibers with the binder emulsion, followed by a moderate heating to dry the mass. This moderate heating also serves to cure the binder by forming a crosslinked interpolymer. Before the binder is applied, it is, of course, mixed with a suitable catalyst for the crosslinking monomer. For example, an acid catalyst such as mineral acids, e.g. hydrogen chloride, or organic acids, e.g. p-toluenesulfonic acid, oxalic acid, or acid salts such as ammonium chloride, are suitably used as is known in the art. The amount of catalyst is generally from 0.5–2% of the total polymer.

The starting fiber layer or mass can be formed by any one of the conventional techniques for depositing or arranging fibers in a web or layer. These techniques include carding, garnetting, air-laying, wetlaying and the like. Individual webs or thin layers formed by one or more of these techniques can also be laminated to provide a thicker layer for conversion into a fabric. Typically, the fibers extend in a plurality of diverse directions in general alignment with the major plane of the fabric, overlapping, intersecting and supporting one another to form an open, porous structure.

When reference is made to "cellulose" fibers, those fibers containing predominantly $C_6H_{10}O_5$ groupings are meant. Thus, examples of the fibers to be used in the starting layer are the natural cellulose fibers such as wood pulp, cotton and hemp and the synthetic cellulose fibers such as rayon, and regenerated cellulose. Often the fiber starting layer contains at least 50% cellulose fibers, whether they be natural or synthetic or a combination thereof. Often the fibers in the starting layer may comprise natural fibers such as wool, jute; artificial fibers such as cellulose acetate; synthetic fibers such as polyamides, nylon, polyesters, acrylics, polyolefins, i.e. polyethylene, polyvinyl chloride, polyurethane, and the like, alone or in combination with one another.

The fiber starting layer is subjected to at least one of several types of bonding operations to anchor the individual fibers together to form a self-sustaining web. Some of the better known methods of bonding are overall impregnation or printing the web with intermittent or continuous straight or wavy lines or areas of binder extending generally transversely or diagonally across the web and additionally, if desired, along the web.

The amount of copolymer binder, calculated on a dry basis, applied to the fiber starting web is that amount which is at least sufficient to bind the fibers together to form a self-sustaining web and suitably ranges from about 3 to about 100% or more by weight of the starting web, preferably from about 10 to about 50 wt % of the starting web. The impregnated web is then dried and cured. Thus, the nonwoven products are suitably dried by passing them through an air oven or the like and then through a curing oven. Typical conditions to achieve optimal crosslinking are sufficient time and temperature such as drying at 150°–200° F. 66°–93° C. for 4–6 minutes, followed by curing at 300°–310° F.(149°–154°C. for 3–5 minutes or more. However, other time-temperature relationships can be employed as is well known in the art, shorter times and higher temperature or longer times at lower temperature being used. The following examples demonstrate that the incorporation of acrylamide into vinyl acetate/ethylene copolymers containing AGA or an ABDAtype crosslinking monomer provides formaldehyde-free copolymer binders with block resistance that is essential for nonwoven binder performance.

EXAMPLE 1

A one-gallon reactor was charged with 1364.8 g vinyl acetate, 7.6 g Igepal CO887 surfactant, 33.9 g Siponate DS-10 surfactant, 1.6 g triallyl cyanurate, 27.0 g sodium vinyl sulfonate (25% in $H_2O$), 1142.7 g of a 2% aqueous solution of Natrosol 250 LR hydroxyethyl cellulose, 5.5 g sodium acetate, 0.05 g ferric ammonium sulfate and 0.5 g phosphoric acid. The reactor was purged for 40 minutes with nitrogen and then heated to 48° C., agitated at 800 rpm, pressurized with ethylene to 340 psig and charged with 30.4 g of a 3.5% aqueous solution of sodium acetone bisulfite (SAB) reducing agent. The reaction was initiated by adding 1.5% aqueous solution of t-butyl hydroperoxide (TBHP) oxidizing agent at 0.2 ml/min. Upon initiation the rate of addition was switched to automatic to maintain a 5° C. exotherm and 493 g of a monomer solution (55.0 g AGA and 17.5 g acrylamide in 477.5 g deionized water) was added at 2.0 ml/min. Ten minutes after initiation, a 3.5% aqueous solution of SAB was added at 0.3 ml/min. The reactor temperature was maintained at 49° C. and the pressure at 340 psig. After four hours, the AGA and acrylamide monomer feed was complete but the reducing agent and oxidizing agent feeds continued for an additional five minutes. Thereupon, the reaction was cooled, degassed and treated with 5 g of 10% aqueous solution of TBHP and 4.6 g of 50% aqueous solution of Colloid 585 defoamer. Solids: 43.0%; Viscosity: 660 cps.

EXAMPLE 2

This Example was a repeat of Example 1 except the monomer solution contained 55.0 g AGA and 12.6 g acrylamide in 482.4 g deionized water. Solids: 43.4%; Viscosity: 208 cps.

EXAMPLE 3

This Example was a repeat of Example 1 except the monomer solution contained 55.0 g AGA and 8.7 g acrylamide in 487.3 g deionized water. Solids: 42.4%; Viscosity: 540 cps.

EXAMPLE 4

This Example was repeat of Example 1 except the monomer solution contained 55.0 g AGA and 4.8 g acrylamide in 491.2 g deionized water. Solids: 42.2%; Viscosity: 380 cps.

EXAMPLE 5

This Example was repeat of Example 1 except the monomer solution contained only 55.0 g AGA in 495 g deionized water. Solids: 42.6%; Viscosity: 280 cps.

EXAMPLE 6

A one-gallon reactor was charged with 1364.8 Bg vinyl acetate, 7.6 g Igepal COB887 surfactant, 33.9 g Siponate DS-10 surfactant, 1.6 g triallyl cyanurate, 27.0 g sodium vinyl sulfonate (25% in $H_2O$), 1142.7 g of a 2% aqueous solution of Natrosol 250 LR hydroxyethyl cellulose, 5.5 g sodium acetate, 0.05 g ferric ammonium sulfate and 6.7 g phosphoric acid. The reactor was purged for 40 minutes with nitrogen and then heated to 48° C., agitated at 800 rpm, pressurized with ethylene to 340 psig and charged with 30.4 g of a 0.7% aqueous solution of sodium acetone bisulfite (SAB) reducing agent. The reaction was initiated by adding 0.3% aqueous solution of t-butyl hydroperoxide (TBHP) oxidizing agent at 0.2 ml/min. Upon initiation the rate of addition was switched to automatic to maintain a 5° C. exotherm and 32 g of a 50% aqueous solution of acrylamide was added at 0.2 ml/min. Ten minutes after initiation, a 0.7% aqueous solution of SAB was added at 0.3 ml/min. The reactor temperature was maintained at 49° C. and the pressure at 340 psig. At the ninety minute mark the oxidizing agent was switched to a 1.5% aqueous solution of TBHP and the reducing agent to a 3.5% aqueous solution of SAB. Two hours after initiation the acrylamide delay was complete and 493.3 g of acrylamidobutyraldehyde diethyl acetal (ABDA) dela (10% ABDA in deionized water) was begun at 4.0 ml/min. After four hours, the ABDA feed was complete but the oxidizing agent and reducing agent feeds were continued for an additional five minutes. Thereupon, the reaction was cooled, degassed and treated with 5 g of 10% aqueous solution of TBHP and 4.6 g of 50% aqueous solution of Colloid 585 defoamer. Solids: 42.6%; Viscosity: 660 cps.

EXAMPLE 7

This Example was a repeat of Example 6 except the acrylamide delay was only 24.0 g of a 50% aqueous solution added at 0.15 ml/min. Solids: 43.8%; Viscosity: 368 cps.

EXAMPLE 8

This Example was a repeat of Example 6 except the acrylamide delay was only 16.0 g of a 50% aqueous solution added at 0.1 ml/min. Solids: 43.0%; Viscosity: 280 cps.

EXAMPLE 9

This Example was a repeat of Example 6 except there was no acrylamide delay. Solids: 42.8%; Viscosity: 300 cps.

EXAMPLE 10

This Example was a repeat of Example 6 except the acrylamide was charged to the reactor with the surfactants rather than added as a delay. Solids: 42.4%; Viscosity: 740.

EXAMPLE 11

This Example was the same as Example 6 except the acrylamide delay was added at 0.1 ml/min. and took four hours to add rather than two. Solids: 41.6%; Viscosity: 480 cps.

The copolymers of Examples 1–11 were applied as binder emulsions to Whatman paper at 10% binder solids. Phosphoric acid to pH 2.5 was added as a curing catalyst and the impregnated paper was dried and cured at 150° C. for 3 minutes. Tensile strengths were determined.

The blocking resistance was determined as follows:

A cotton poplin cloth is saturated with a binder emulsion which has been diluted to 40% solids and either adjusted to pH 2.5 with 10% phosphoric acid or contained 1% ammonium chloride based on polymer solids. The saturated cloth is dried on a hot (180° F.) Teflon-coated metal surface until steam no longer appears making sure there is a uniform coating on the surface of the cloth. The binder is then cured.

Cloth samples are placed film-side to film-side in a stack using Mylar film between each sandwich. The stack is exposed to 0.33 psig by a metal plate at 140° F. for 12 hours. After cooling to ambient room temperature while still under pressure (0.33 psig), the blocking level was determined by measuring on an Ohaus spring scale the amount of pull needed to separate the adjacent cloth samples.

TABLE

| Example | X-Linker (%) | AM (%) | TENSILE STRENGTH (pli) DRY | WET | MEK | BLOCKING (gli) |
|---|---|---|---|---|---|---|
| 1 | AGA (3) | 1.00 | 16.6 | 6.2 | 5.5 | 5.1 |
| 2 | " | .72 | 17.1 | 6.5 | 5.2 | 5.5 |
| 3 | " | .50 | 16.4 | 6.0 | 4.9 | 16.8 |
| 4 | " | .27 | 16.1 | 5.6 | 5.6 | 26.5 |
| 5 | " | 0.00 | 15.9 | 5.9 | 5.3 | 106.9 |
| 6 | ABDA (3) | 1.00 | 17.1 | 5.5 | 7.6 | 17.7 |
| 7 | " | .75 | 17.5 | 6.1 | 6.7 | 58.2 |
| 8 | " | .50 | 17.6 | 6.1 | 6.7 | 83.9 |
| 9 | " | 0.00 | 18.1 | 6.3 | 7.2 | 127.3 |
| 10 | " | 1.00[a] | 17.6 | 6.3 | 6.9 | 59.4 |

TABLE-continued

| Example | X-Linker (%) | AM (%) | TENSILE STRENGTH (pli) DRY | WET | MEK | BLOCKING (gli) |
|---|---|---|---|---|---|---|
| 11 | " | 1.00[b] | 17.5 | 6.1 | 7.7 | 10.9 |

AM = acrylamide
[a]Acrylamide was batched up-front
[b]Acrylamide delay was twice as long as in Example 6.

It can be seen from the data in the table that incorporating relatively small amounts of acrylamide into a vinyl acetate/ethylene copolymer binder containing either AGA or ABDA as the crosslinking comonomer provides for a significant reduction in blocking of the bonded non-woven sample.

It can be seen in comparing Example 10 with Example 6 that adding the acrylamide monomer all up front in the polymerization reaction as opposed to adding it on a delay basis throughout the reaction is not as effective in affording blocking resistance. Also delaying the addition of the acrylamide over a longer period of time (Example 11 compared to Example 6) provided even better blocking resistance.

EXAMPLE 12

This Example was a repeat of Example 1 except that the 7.6 g Igepal CO887 surfactant was replaced by 15.2 g Rewopol NOS25 surfactant. Solids: 44.6%: viscosity: 140 cps; blocking: 1.9 gli. The replacement of the nonionic surfactant with anionic surfactant further improved blocking resistance.

EXAMPLE 13

This Example was a repeat of Example 12 except that the 1142.7 g of a 2% aqueous solution of Natrosol 250LR hydroxyethyl cellulose was replaced with 571.35 g of a 5.4% aqueous solution of Natrosol 250LR hydroxyethyl cellulose. Solids: 49.6%; viscosity: 360 cps; blocking: 3 gli.

EXAMPLE 14

This Example was a repeat of Example 1 except that the 1142.7 g of a 2% aqueous solution of Natrosol 250LR hydroxyethyl cellulose was replaced with 540.3 g of deionized water, the Siponate DS-10 surfactant was increased to 55.9 g and the 7.6 g Igepal CO887 surfactant was replaced with 25.2 g Rewopol NOS25 surfactant. Solids: 54.8%; viscosity: 480 cps; blocking: 8 gli. A fully anionic suspending system did not provide as good blocking resistance as the anionic suspending systems which also included the hydroxyethyl cellulose.

Statement of Industrial Application

The invention provides vinyl acetate/ethylene/AGA or ABDA/acrylamide copolymer emulsion binders useful for the preparation of non-woven product.

I claim:

1. In a copolymer emulsion for bonding nonwovens comprising an aqueous medium having colloidally dispersed therein a copolymer consisting essentially of vinyl acetate, ethylene and crosslinkable comonomer which is an N-acrylamidoglycolic acid or a compound of the formula $$R—NH-(CH_2)_nCH(OR^1)_2$$

wherein

R is a $C_3$–$C_{10}$ olefinically unsaturated organic radical having functionality which renders the nitrogen atom electron deficient, $R^1$ is hydrogen or $C_1$–$C_4$ alkyl group, and n is 3 or 4, the improvement for reducing blocking of nonwovens which comprises the copolymer also containing 0.1 to 5 wt % of an acrylamide.

2. The copolymer emulsion of claim 1 in which the copolymer contains 0.5 to 1.5 wt % of an acrylamide.

3. The copolymer emulsion of claim 1 in which the copolymer contains acrylamide.

4. The copolymer emulsion of claim 1 in which the copolymer contains methacrylamide.

5. A copolymer emulsion for reduced blocking of nonwovens comprising an aqueous medium having colloidally dispersed therein a copolymer consisting essentially of vinyl acetate, 1 to 20 wt % ethylene, 0.5 to 15 wt % (based on vinyl acetate) crosslinkable comonomer which is an N-acrylamidoglycolic acid, and 0.1 to 5 wt % of an acrylamide.

6. The copolymer emulsion of claim 5 which contains 0.5 to 1.5 wt % of an acrylamide.

7. The copolymer emulsion of claim 6 in which the copolymer contains 16 to 18 wt % ethylene.

8. The copolymer emulsion of claim 7 in which the copolymer contains 2 to 9 wt % of an N-acrylamidoglycolic acid.

9. A copolymer emulsion for reduced blocking of nonwovens comprising an aqueous medium having colloidally dispersed therein a copolymer consisting of essentially of (a) vinyl acetate, (b) 1 to 20 wt % ethylene, (c) 0.5 to 15 wt %, based on vinyl acetate, crosslinkable conomomer of the formula:

$$R-(NH—(CH_2)—CH(OR^1)_2$$

wherein

R is a $C_3$–$C_{10}$ alkenoyl group, $R^1$ is methyl or ethyl and n is 3 or 4, and (d) 0.1 to 5 wt % of an acrylamide.

10. The copolymer emulsion of claim 9 in which R is (meth)acrylyl and n is 3.

11. The copolymer emulsion of claim 10 in which the copolymer contains 0.5 to 1.5 wt % acrylamide.

12. The copolymer emulsion of claim 11 in which the copolymer contains 16 to 18 wt % ethylene.

13. The copolymer emulsion of claim 12 in which the copolymer contains 2 to 9 wt % crosslinkable monomer.

* * * * *

UNITED STATES PATENT AND TRADEMARK OFFICE

CERTIFICATE OF CORRECTION

PATENT NO. : 4,774,283

DATED : 27 September 1988

INVENTOR(S) : Joel E. Goldstein

It is certified that error appears in the above-identified patent and that said Letters Patent is hereby corrected as shown below:

Column 12, Line 48

Delete "R ( NH-$(CH_2)$-$CH(OR^1)_2$" and substitute therefor --R-NH--$(CH_2)_n$--$CH(OR^1)_2$--

Signed and Sealed this

Seventh Day of March, 1989

*Attest:*

DONALD J. QUIGG

*Attesting Officer*

*Commissioner of Patents and Trademarks*